United States Patent [19]

Wilkes

[11] 4,369,903

[45] Jan. 25, 1983

[54] BACKPACK FRAME

[76] Inventor: Donald F. Wilkes, 2816 Charleston NE., Albuquerque, N. Mex. 87110

[21] Appl. No.: 283,853

[22] Filed: Jul. 16, 1981

[51] Int. Cl.[3] ..... A45F 3/10

[52] U.S. Cl. ..... 224/213; 224/212; 224/211

[58] Field of Search ..... 224/212, 210, 211, 213, 224/153, 154, 155, 156

[56] References Cited

U.S. PATENT DOCUMENTS 4,214,685 7/1980 Pletz ..... 224/213 X

FOREIGN PATENT DOCUMENTS 54186 7/1934 Norway ..... 224/212
242069 9/1946 Switzerland ..... 224/212

OTHER PUBLICATIONS

North Face, 1981 Spring–Summer Catalogue.

*Primary Examiner*—Steven M. Pollard

*Attorney, Agent, or Firm*—Burns, Doane, Swecker & Mathis

[57] ABSTRACT

A pack frame for a backpack which includes structure for transferring a substantial portion of the vertical load component to a position at the hip area of a wearer which is well below the load's center of gravity. The pack frame is comprised of a tubular frame structure which is adapted to support a load on the back of a wearer. A pair of crossed, diagonally extending links connect the upper part of the frame structure to a belt-like support means, e.g. hip saddle, which is adapted to be worn about the hips of the wearer. Each of the links is bent into an arch configuration and is rotatably connected to both the frame structure and the hip saddle by means of bearing-supported ball joints so that the frame fits compactly and comfortably on the wearer and does not substantially interfere with most normal body movements of the wearer. Straps are attached to the upper part of the frame structure and are adapted to extend over the shoulders of the wearer before they are attached to the hip saddle.

19 Claims, 15 Drawing Figures

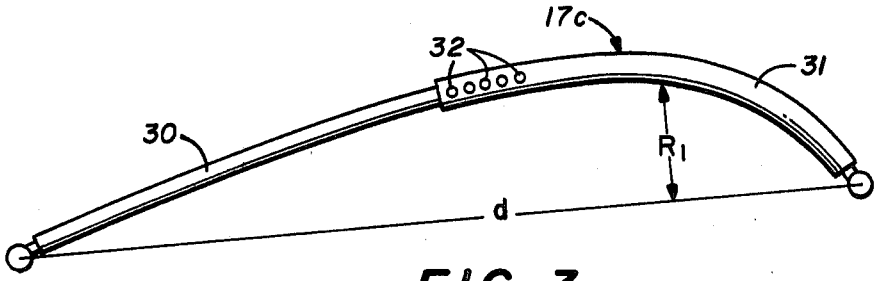
FIG. 3
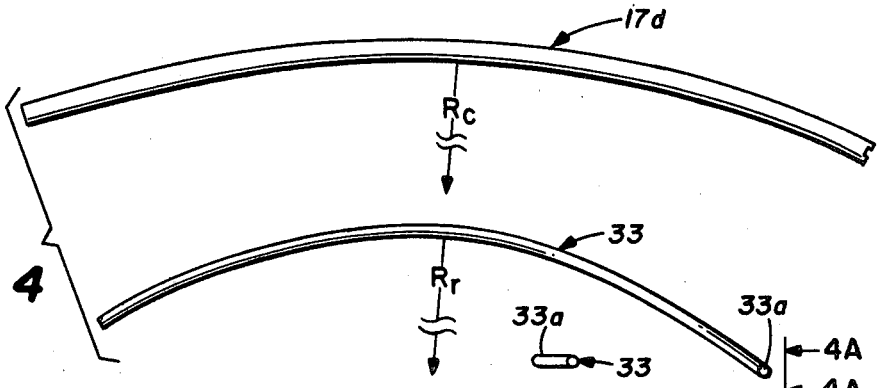
FIG. 4
FIG. 4A
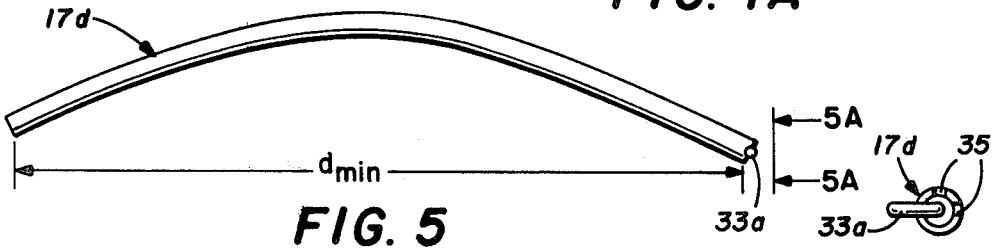
FIG. 5
FIG. 5A
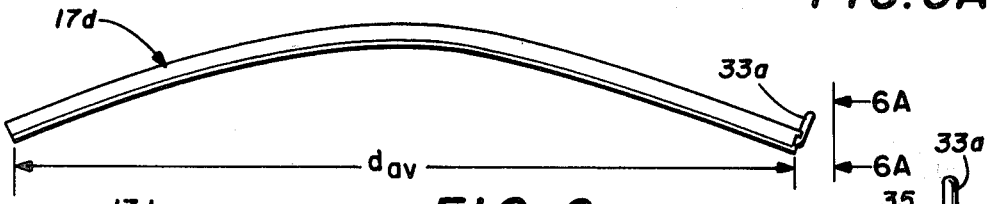
FIG. 6
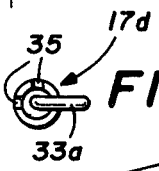
FIG. 7A
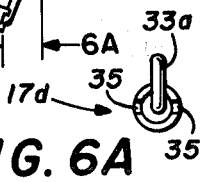
FIG. 6A
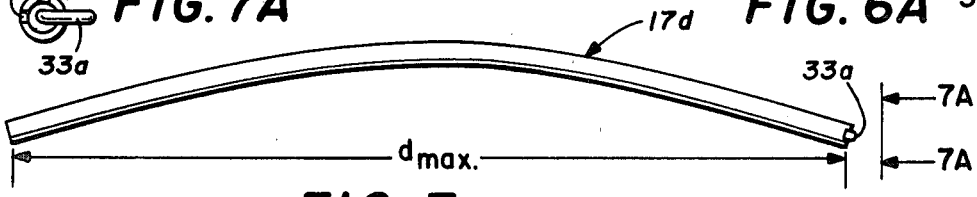
FIG. 7

BACKPACK FRAME

BACKGROUND OF THE INVENTION

The present invention relates to a backpack to be carried by a human and more particularly relates to a backpack frame for carrying relatively large loads while providing good stability and allowing substantial freedom of movement for the wearer.

Campers, alpinists, military personnel, and the like have long used backpacks to physically transport large loads over long distances and/or rough terrains. Typical of such backpacks are those which include a pack frame for suspending the load on the back of the wearer. Conventional pack frames employ shoulder straps to hold the backpack up in position on the back of the wearer. Such straps, however, also introduce a forward tension which counteracts the overturning moment of the pack and keeps the pack from toppling over backward. This continuous tension from the shoulder straps interferes with blood circulation under the straps, and results in a sustained tension in the shoulder and chest muscles. Accordingly, if only the shoulders and the upper back are used in carrying large loads, the discomfort to a wearer caused by shoulder straps of conventional packs can become excessive.

To alleviate this problem, many modern pack frames now include an elongated, board-like member which along with additional structure, straps, and/or padding distribute a part of the vertical component of the load to a belt-like structure worn about the hips of the wearer. This distribution of load appreciably decreases the shoulder tension and produces a lower resultant coupling to the body of the wearer thereby improving the wearer's dynamic stability and ability to maintain balance under rough conditions.

However, known means used in backpacks for distributing the load between the shoulders and hips have tended to interfere with the wearer's inherent counter-rotative body motions and have had an adverse effect on the wearer's ability to maintain balance while walking under pack, especially on terrain with a changing contour. This interference with normal body motions can also produce cyclic impulsive loading at the shoulder strap and hip contact points which, in turn, may lead to muscle soreness, cramps or chafing and even bruises under severe circumstances.

SUMMARY OF THE INVENTION

The present invention provides a pack frame for a backpack which includes structure for transferring a substantial portion of the vertical load component to a position at the hip area of a wearer which is well below the load's center of gravity.

Basically, this load transferring structure, i.e. "crossed-four bar linkage," closely simulates the crossed-tendons within the torso and back of human body which automatically permits a counterbalancing of the dynamic movements required of the lower limbs in bipedal locomotion, i.e. walking. A horizontal cross member near the upper part of the frame structure simulates the shoulders of a wearer while a belt-like support, e.g. hip saddle, simulates his hip area. Two crossed, diagonally-extending links connect the upper cross member to the hip saddle and provide the primary structure by which a portion of a load mounted on the frame structure is transferred to the hip saddle. Straps are attached to the cross member and are adapted to extend over the shoulder of a wearer before being attached to the hip saddle.

To allow the pack frame to fit comfortably and compactly around the body of a wearer, each of the cross links are bent to form an arch which can be adjusted in length to accommodate different sized wearers, as will be explained in more detail below. Further, to allow a wearer to achieve a wide range of movement, both cross links are connected to both the cross member and the belt support by means of free-wheeling ball joints. A restraining means maintains the cross links in their relative positions without substantially interferring with the relative movement therebetween.

BRIEF DESCRIPTION OF THE DRAWINGS

The actual construction, operation, and the apparent advantages of the invention will be better understood by referring to the drawings in which like numerals identify like parts and in which:

FIG. 3 is an elevational view of an embodiment of a link used in the pack frame of FIGS. 1 and 2;

FIG. 4 is an exploded view of another embodiment of a link used in the pack frame of FIGS. 1 and 2;

FIG. 4A is an enlarged view taken along line A—A of FIG. 4;

FIG. 5 is an elevational, assembled view of the link of FIG. 4 in a first condition;

FIG. 5A is an enlarged view taken along line A—A of FIG. 5;

FIG. 6 is an elevational, assembled view of the link of FIG. 4 in a second condition;

FIG. 6A is an enlarged view taken along line A—A of FIG. 6;

FIG. 7 is an elevational, assembled view of the link of FIG. 4 in a third condition;

FIG. 7A is an enlarged view taken along line A—A of FIG. 7.

DETAILED DESCRIPTION OF THE PREFERRED EMBODIMENTS

Studies of the normal walking patterns of human beings have revealed that balance during walking is maintained by a continual counter-rotation between hips and shoulders plus a dynamically synchronized swing of the arms. Inherent in the knee joint is a built-in change in leverage which provides the continual changes in power and speed to permit a few muscle sets of the body to perform the required complex sequence of movements in perfectly self-coordinated fashion. Coupled to this variability in leverage within the knee joint, is a hip action which, in combination with the knee action, permits normal walking and permits weight to be shifted from one leg to the other without any appreciable raising and lowering of the body's center of gravity, hence saving a cyclical energy loss. All this would be for naught however, were it not for the cross-coupled tendons within the torso and back which automatically permit a counter-balancing for the dynamic movements required of the lower limbs for bipedal locomotion.

The pack frame of the present invention provides a highly effective structure for transferring a substantial part of the pack load to a position at the hip area of a wearer which is well below the load's center of gravity while, at the same time, permitting a wide range in freedom of movement by closely simulating this natural cross-coupling of the wearer's body.

Figure 2:
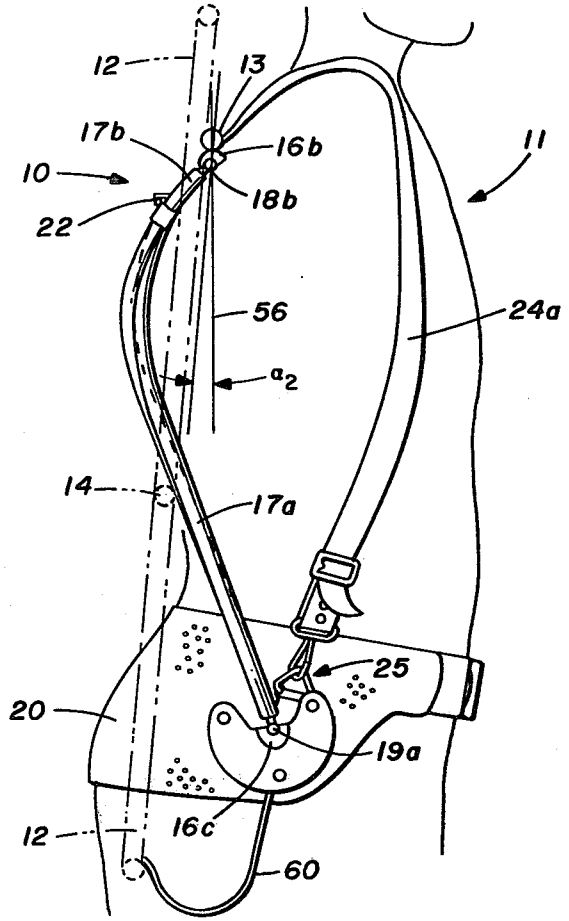
FIG. 2 is a side view of FIG. 1.
Figure 1:
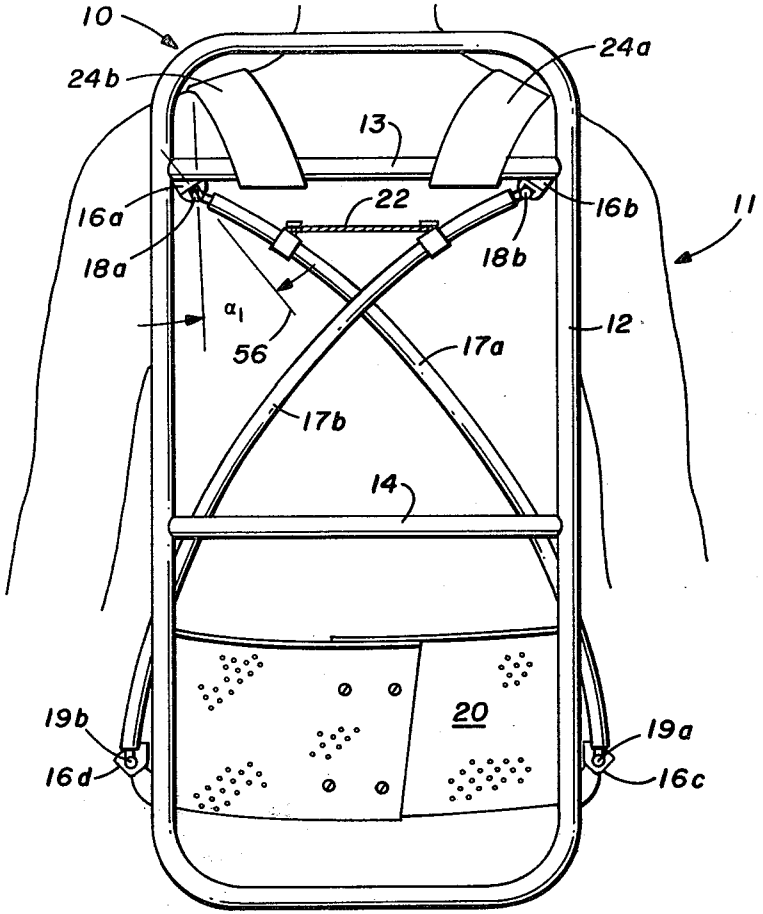
FIG. 1 is an elevation view of the present pack frame in an operable position on the back of a wearer.

Referring more particularly to the drawings, FIGS. 1 and 2 disclose pack frame 10 of the present invention in position on the back of wearer 11. Pack frame 10 is comprised of frame structure 12 which is preferably formed from lightweight tubing (e.g. 0.625 inch O.D., thin-walled 6061-T aluminum tubing), bent into an elongated, rectangular configuration as illustrated in the figures. Frame structure 12 has an upper cross member 13 near the top thereof and an intermediate cross member 14 (preferably formed of the same material as frame structure 12) secured thereto to form an integral part of frame structure 12.

Attached to the underside of upper cross member 13 are ball sockets 16*a*, 16*b* which are positioned near the relative right and left sides, respectively, of frame structure 12. Link 17*a* has ball joints 18*a*, 19*a* secured to its upper and lower ends, respectively. Ball joint 18*a* is secured in ball socket 16*a* to thereby rotatably attach the upper end of link 17*a* to the relative left side of frame structure 12. Ball joint 19*a* is secured in ball socket 16*c* which is mounted on the relative left side of belt-like support means, e.g. adjustable hip saddle 20, to thereby rotatably attach link 17*a* to said hip saddle.

Link 17*b* has ball joints 18*b*, 19*b* secured to its upper and lower ends, respectively. Ball joint 18*b* is secured in ball socket 16*b* to thereby rotatably attach the upper end of link 17*b* to the relative right side of frame structure 12. Ball joint 19*b* is secured in ball socket 16*d* which is mounted on the relative left side of hip saddle 20 to thereby rotatably attach link 17*b* to said hip saddle.

Retaining means, e.g. spring 22, is connected at one end 22*a* to an intermediate position on link 17*a* and at its other end 22*b* to an intermediate position on link 17*b* to maintain links 17*a*, 17*b* in their basic crossed relationship without substantially interferring with relative movement between the links. Adjustable straps 24*a*, 24*b* are connected to upper cross member 13 and are adapted to extend across the respective shoulders of wearer 11 and to be releasably connected at their respective lower ends to hip saddle 20 by means of hook and eye 25.

To allow frame 10 to fit compactly on wearer 11, each of links 17*a*, 17*b* (both are identical) is bowed or bent in the form of an arch. Ideally, each link 17*a*, 17*b* would be formed exactly to fit the actual dimensions (height, hip size, etc.) of a particular wearer. In the commercial world, however, this is impractical since a supplier normally must stock "one size fits all" merchandise. Based on studies which indicate that all humans are somewhat similarly proportioned, a standardized pack frame in accordance with the present invention can be designed for the average male adult with the differences in the physiques of various wearers and between male and female being readily accommodated therein. Height variations can be accommodated by changing the effective lengths of the links 17*a*, 17*b* and, if necessary, the distance between ball sockets 16*a* and 16*b* on cross member 13. These studies further revealed that to accommodate approximately 98% of the populace (men and women), links 17*a*, 17*b* need to have an adjustable distance d (FIG. 3) of approximately 18 to 25 inches. The maximum bowed distance $R_1$ (FIG. 3) in links 17*a*, 17*b* will vary depending on other factors, e.g. load to be carried, etc., but will normally be between 4 to 5 inches.

In the embodiment illustrated in FIG. 3, link 17*c* is comprised of two tubular sections, 30, 31, with section 30 being telescoped within section 31. A plurality of holes 31 are provided at spaced intervals through both sections 30 and 31 which when aligned in different relative positions, adjust the effective length d of link 17*c*. A pin, bolt, detent, or the like (not shown) is placed through the aligned holes to lock the sections together at their desired position.

In a preferred embodiment shown in FIGS. 4 and 5, link 17*d* is comprised of a length (24 inches) of tubular material, e.g. 0.375 inch OD, 0.305 inch ID, 6061-T-6 aluminum tubing, which is bent in a continuously curving arch wherein the radius of curvature $R_c$ equal approximately 17 inches. A shaping rod 33, e.g. steel, having a length of approximately 16 inches is formed in a continuously curving arch wherein the radius of curvature equals approximately 8 inches. Shaping rod 33 is forced into link 17*d* wherein due to the difference in radii of curvatures between rod 33 and link 17*d*, the height and radius of the arch and incidentally the length of link 17*d* can be varied by rotating rod 33 within link 17*d*. FIGS. 5–7, although not necessarily to scale, illustrates this adjustment feature.

Rod 33 has an operating means, e.g. lever 33*a*, at one end as shown in FIG. 4A which cooperate with detent means, e.g. slots 35 in link 17*d* (FIGS. 5A–7A) by which rod 33 may be rotated within link 17*d* and held in a desired position. Although only three positions, i.e. slots 35, are shown, it should be recognized that fewer or more than three positions could be provided without departing from the present invention.

When lever 33*a* in the position shown in FIG. 5A, $R_r$ of rod 33 substantially aligns with $R_c$ but being less than $R_c$, link 17*d* will attain additional curvature and will achieve its minimum effective length $d_{min}$, which also corresponds with its most springy orientation. When lever 33*a* is in the position shown in FIG. 6A, $R_r$ of rod 33 is 90° out of alignment with $R_c$ of link 17*d* and link 17*d* thereby acquires its average effective length, $d_{av}$ which also corresponds with its average springiness setting. When lever 33*a* is in the position shown in FIG. 7A, $R_r$ of rod 33 is fully opposed to $R_c$ of link 17*d* which "flattens" link 17*d* to its maximum effective length $d_{max}$ and minimum curvature which corresponds with its stiffest orientation.

In addition to allowing frame 10 to comfortably fit on a wearer's back as mentioned above, by curving links 17*a*, 17*b* a high degree of vertical compliance for the frame 10 is also provided. That is, the curvature of links 17*a*, 17*b* will increase when the load being carried is increased. Also, links 17*a*, 17*b* can bend resiliently whenever a vertical shock is experienced such as when a wearer jumps or when his heel impacts the ground during walking. This is important, especially when a wearer is descending rapidly under pack since the springiness of the links can readily absorb the excessive shocks normally experienced during such a maneuver.

Figure 8:
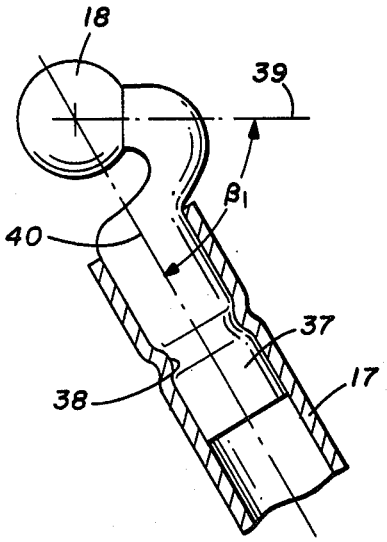
FIG. 8 is an elevational view, partly in section, of the upper end of a link used in the pack frame of FIGS. 1 and 2.
Figure 9:
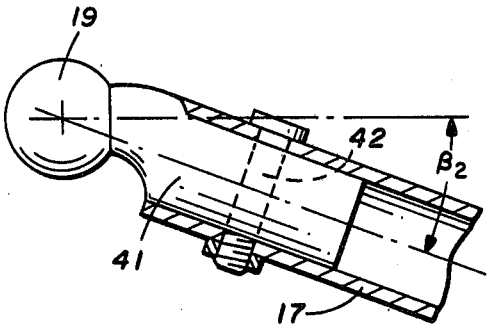
FIG. 9 is an elevational view, partly in section, of the lower end of a link used in the pack frame of FIGS. 1 and 2.
Figure 10:
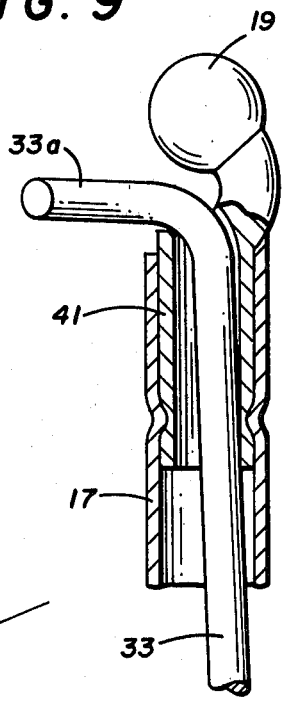
FIG. 10 is an elevational view, partly in section, of another embodiment of the lower end of a link used in the pack frame of FIGS. 1 and 2.

Links 17*a*, 17*b* are connected to cross member 13 and to belt-like support means 20 to provide maximum movement with minimum effort. As previously described, this is accomplished by using ball joints on links 17 which cooperate with ball sockets on cross member 13 and belt-like support 20. As illustrated in FIG. 8, upper ball joint 18 (both 18*a*, 18*b*) (e.g. 0.375 inch diameter ball) has a shank portion 37 which is positioned into the upper end of link 17 and is held therein by any known means, e.g. crimping of link 17 into groove 38 on shank 37. The nominal axis 39 of upper ball joint 18 is canted off axis 40 of shank 37 at a preferred angle at 61.5°. Lower ball joint 19 (both 19*a*, 19*b*) has a shank 41 (FIG. 9) which is positioned in the lower end of link 17 and is held therein by any suitable means, e.g. bolt 42. Nominal axis 43 of lower ball joint 19 is canted off axis 44 of shank 41 at a preferred angle of 17°. FIG. 10 illustrates a bottom ball joint for use with shaping rod 33 of the embodiment shown in FIGS. 4–7.

Figure 11:
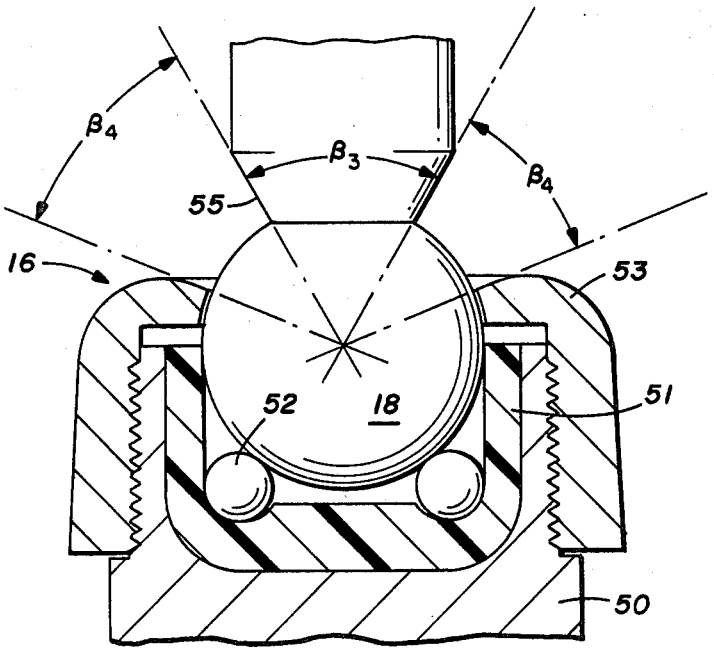
FIG. 11 is an elevational view, partly in section, of a ball socket used in the pack frame of FIGS. 1 and 2.

To increase the total relative movements between frame structure 12, belt-like support means 20, and crossed links 17*a*, 17*b*, ball sockets 16 (FIG. 11) are provided which allows cyclic, rotational swivelling of the links relative to their respective supports while virtually eliminating the energy loss normally associated therewith. Ball socket 16 (16*a*–16*d*) is comprised of a support 50 having a bearing race 51 therein which is preferably formed for a self-lubricating material, e.g, nylon impregnated with graphite. A plurality of bearings 52 (e.g. 9 balls) are positioned on race 51 and are adapted to receive the ball joints 18 or 19, as the case may be. Retainer 53 is threaded onto support 50 to secure ball joint 18 in ball socket 16.

To insure a high degree of pivotable mobility, the juncture 55 between ball 18 and shank 37 (FIG. 11) is tapered so angle $\beta_3$ equals approximately 60°. Retainer 53 is designed so that angles $\beta_4$ each equal approximately 40°. This allows an exceedingly wide range of movement between link 17 and ball sockets 16. To further add to this range of movement, the upper ball sockets 16*a*, 16*b* are mounted on cross member 13 so the central axis 56 of ball socket 16 is canted off the vertical at an angle $\alpha$, (FIG. 1) equal to approximately 55° and off parallel with frame member 12 at an angle $\alpha_2$ (FIG. 4) equal to approximately 11°.

Preferably both of cross links 17*a*, 17*b* are coated or covered with a smooth, anti-wear material, e.g. plastic tubing, which reduces friction, wear, and noise caused by sliding contact between the links. One link is preferably covered with a first plastic and the other link covered with a second plastic (e.g. polyethylene having differing hardnesses) since wear is normally less between two dissimilar materials. Further, controlled lengths 60 of nylon cords or the like (only one shown in FIG. 2) are provided between frame structure 12 and belt support 20 to prevent forces created by an otherwise dangling belt support 20 from damaging the ball joints on links 17 when pack frame 10 is not in position on a wearer 11. Likewise guard tubes or limit stops (not shown) may be provided for upper ball sockets 16*a*, 16*b* to protect links 17*a*, 17*b* against any undue twisting or excessive leverage which otherwise may occur. Also, a formed sheet of Mylar or the like (not shown) can be mounted on frame structure 12 between the actual pack sack or load (not shown) and frame structure 12, shaped to permit the full range of useful link mobility but which will prevent damaging movement of the links when frame is not being carried on wearer's back and will prevent items in the pack sack from interferring with the links' mobility.

What is claimed is:

1. A pack frame for supporting a load on the back of a human wearer, said pack frame comprising:

a frame structure;

a belt-like support means adapted to fit about the hips of the wearer, crossed-linkage means for flexibly connecting the upper portion of said frame structure to said belt-like support means, strap means attached at one end to said upper portion of said frame structure and adapted to pass over the shoulders of said human wearer; and means to attach the other end of said strap means to said belt-like support means.

2. The pack frame of claim 1 wherein said frame structure has relative right and left sides and said belt-like support means has similarly aligned relative right and left sides and wherein said crossed-linkage means comprises:

a first link, means for rotatably connecting one end on said first link to said left side of frame support near the top thereof, means for rotatably connecting the other end of said first link to said right side of said belt-like support means, a second link, means for rotatably connecting one end of said second link to said right side of said frame support near the top thereof, and means for rotatably connecting the other end of said second link to said left side of said belt-like support means whereby said first and second links cross each other to provide a flexible connection between the upper portion of said frame structure and said belt-like support means.

3. The pack frame of claim 2 including:

means for retaining said first and second links in their relative crossed positions while allowing relative movement therebetween.

4. The pack frame of claim 3 wherein said retaining means comprises:

a spring means having one end attached to an intermediate position of said first link and having the other end attached to an intermediate position on said second link.

5. The pack frame of claim 2 or 3 wherein each of said first and second links are bent to form arch-like members which curve away from the back of said wearer when said pack frame is in an operable position.

6. The pack frame of claim 2 or 3 wherein each of said first and second links comprises:

a tubular member being bent in an arch-like configuration.

7. The pack frame of claim 6 wherein said tubular member comprises:

a first arched tubular section, a second tubular section, said first and second tubular sections being positioned in a telescoping relationship to each other, and means for securing said first and second tubular sections together at different positions relative to each other to thereby adjust the effective lengths of said links.

8. The pack frame of claim 6 wherein each of said tubular members are formed in a continuous arch which has a substantially constant radius of curvature.

9. The pack frame of claim 8 including:

a pair of shaping rods, each of said rods formed in a continuous arch which has a substantially constant radius of curvature which is less than the radius of curvature of said tubular members, one of said shaping rods being positioned in said tubular member forming said first link and the other of shaping rods being positioned in said tubular member forming said second link, said rods being rotatable within said their respective tubular members to thereby adjust the effective lengths of said links.

10. The pack frame of claim 6 wherein said link means includes:

anti-wear, friction reducing surfaces thereon where said two crossed links contact each other.

11. The pack frame of claim 10 wherein said anti-wear, friction reducing surfaces comprise:

a first plastic material on one of said links; and a second plastic material on the other of said links, said first and second plastic materials having different hardness values.

12. The pack frame of claim 2 or 3 wherein said means for rotatably connecting said first and second links to said frame structure and said belt-like support means, respectively, each comprise:

a ball joint attached to a respective end of one of said links; and a cooperating ball socket attached to the upper portion of said frame structure or to said belt-like support means.

13. The pack frame of claim 12 wherein said ball socket comprises:

a support attached to said frame structure, a bearing race positioned in said support; and a plurality of bearings positioned on said race and adapted to support a respective ball joint when said ball joint is received within said ball socket.

14. A pack frame for carrying loads on the back of a human, said pack frame comprising:

an elongated, rectangularly shaped frame structure formed from tubular material;

a cross support affixed to said frame structure near the top thereof and extending across said frame structure substantially parallel to the top thereof from the relative right side of said frame structure to the relative left side thereof, a first pair of ball sockets, one of said ball sockets mounted on said cross support near said right side of said frame support and the other of said ball sockets mounted on said cross support near said left side of said frame support, a belt-like support means having a relative right and left side aligned with said right and left sides of said frame structure, a second pair of ball sockets, one of said ball sockets mounted on said right side of said belt-like support means and the other of said ball sockets mounted on said left side of said belt-like support means;

a first tubular link bent into an arch-like configuration and having a first ball joint secured to the upper end thereof and a second ball joint secured to the lower end thereof;

a second tubular link bent into an arch-like configuration and having a first ball joint secured to the upper end thereof and a second ball joint secured to the lower end thereof;

means to secure said first ball joint at the upper end of said first link to said ball socket which is mounted near said right side of said frame structure and to secure said second ball joint at said lower end of said first link to said ball socket which is mounted on said left side of said belt-like support means;

means to secure said first ball at the upper end of said second link to said ball socket which is mounted near said left side of said frame structure and to secure said second ball joint on the lower end of said second link to said ball socket which is mounted on said right side of said belt-like support means; and strap means attached to one end to said cross support and adapted to pass over the shoulders of said human; and means to attach the other end of said strap means to said belt-like support means.

15. The pack frame of claim 14 including:

means for retaining said first and second links in their relative crossed positions while allowing relative movement therebetween.

16. The pack frame of claim 15 wherein said retaining means comprises:

a spring means having one end connected to an intermediate position on said first link and having a second end connected to an intermediate position on said second link.

17. The pack frame of claim 16 wherein each of said tubular links are formed in a continuous arch which has a substantially constant radius of curvature.

18. The pack frame of claim 17 including:

a pair of shaping rods, each of said rods formed in a continuous arch which has a substantially constant radius of curvature which is less than the radius of curvature of said tubular members, one of said shaping rods being positioned in said tubular member forming said first link and the other of shaping rods being positioned in said tubular member forming said second link, said rods being rotatable within said their respective tubular members to thereby adjust the effective lengths of said links.

19. The pack frame of claim 16 wherein each of said tubular links comprise:

a first arched tubular section, a second tubular section, said first and second tubular sections being postioned in a telescoping relationship to each other, and means for securing said first and second tubular sections together at different positions to thereby adjust the effective lengths of said links.

* * * * *